US010397718B2

(12) United States Patent
Zhao et al.

(10) Patent No.: US 10,397,718 B2
(45) Date of Patent: Aug. 27, 2019

(54) VIBRATION DIAPHRAGM AND MANUFACTURING METHOD THEREOF

(71) Applicant: GOERTEK INC., Weifang, Shandong (CN)

(72) Inventors: Guodong Zhao, Weifang (CN); Pengcheng Ji, Weifang (CN); Xinfeng Yang, Weifang (CN)

(73) Assignee: GOERTEK INC., Weifang, Shandong (CN)

( * ) Notice: Subject to any disclaimer, the term of this patent is extended or adjusted under 35 U.S.C. 154(b) by 0 days.

(21) Appl. No.: 16/084,479

(22) PCT Filed: May 24, 2016

(86) PCT No.: PCT/CN2016/083090
§ 371 (c)(1),
(2) Date: Sep. 12, 2018

(87) PCT Pub. No.: WO2017/161668
PCT Pub. Date: Sep. 28, 2017

(65) Prior Publication Data

US 2019/0075416 A1 Mar. 7, 2019

(30) Foreign Application Priority Data

Mar. 21, 2016 (CN) ..... 2016 1 0160789

(51) Int. Cl.
*H04R 7/06* (2006.01)
*H04R 31/00* (2006.01)
(Continued)

(52) U.S. Cl.
CPC ..... *H04R 31/003* (2013.01); *H04R 3/002* (2013.01); *H04R 7/06* (2013.01); *H04R 7/16* (2013.01);
(Continued)

(58) Field of Classification Search
CPC . H04R 3/002; H04R 3/06; H04R 7/18; H04R 9/06; H04R 31/00; H04R 31/003;
(Continued)

(56) References Cited

U.S. PATENT DOCUMENTS 2,857,461 A * 10/1958 Brodie ..... H03F 1/36 381/96
3,047,661 A * 7/1962 Winker ..... H03F 1/36 381/96
(Continued)

FOREIGN PATENT DOCUMENTS

CN 104902410 A 9/2015
CN 204948356 U 1/2016
(Continued)

*Primary Examiner* — Huyen D Le
(74) *Attorney, Agent, or Firm* — Saliwanchik, Lloyd & Eisenschenk

(57) ABSTRACT

A vibration diaphragm and a manufacturing method thereof are provided. The vibration diaphragm comprises an annular support member, a first vibration diaphragm layer and a circuit layer. The first vibration diaphragm layer is fixedly connected to a support body of the annular support member. The circuit layer is positioned on a surface of the first vibration diaphragm layer that is adjacent to a vibrating voice coil and is fixedly connected to the first vibration diaphragm layer and the support body. The circuit layer is provided with a circuit area, a capacitance area, and a capacitance solder pad. The capacitance area is a capacitance electrode plate formed on the first vibration diaphragm layer. The capacitance area is communicated with the capacitance solder pad by means of the circuit area. The solder pad corresponds to the support body. The reliability of capacitance data acquisition is improved.

8 Claims, 3 Drawing Sheets

(51) Int. Cl.

| | |
|---|---|
| ***H04R 3/00*** | (2006.01) |
| ***H04R 7/16*** | (2006.01) |
| ***H04R 7/18*** | (2006.01) |
| *H04R 9/06* | (2006.01) |

(52) U.S. Cl.
CPC ..... *H04R 7/18* (2013.01); *H04R 31/00* (2013.01); *H04R 9/06* (2013.01); *H04R 2207/021* (2013.01); *H04R 2231/001* (2013.01)

(58) Field of Classification Search
CPC ..... H04R 2207/021; H04R 2231/001; H04R 2201/003
USPC ... 381/59, 96, 116, 174, 190, 191, 396, 409, 381/410; 29/594, 609.1
See application file for complete search history.

(56) References Cited

U.S. PATENT DOCUMENTS

| | | | | |
|---|---|---|---|---|
| 4,573,189 | A * | 2/1986 | Hall | H04R 3/002 381/396 |
| 2006/0290481 | A1 | 12/2006 | Kitazawa et al. | |
| 2013/0287223 | A1 | 10/2013 | Akino | |

FOREIGN PATENT DOCUMENTS

| | | | |
|---|---|---|---|
| CN | 205029868 | U | 2/2016 |
| CN | 105611463 | A | 5/2016 |
| CN | 205510377 | U | 8/2016 |

* cited by examiner

VIBRATION DIAPHRAGM AND MANUFACTURING METHOD THEREOF

FIELD OF THE INVENTION

The present invention relates to the technical field of electroacoustic products, and in particular to a vibration diaphragm and a manufacturing method thereof.

BACKGROUND OF THE INVENTION

Speakers, as sounding devices of such electronic products as mobile phones, televisions and computers, are widely used in people's daily production and life. Nowadays, there are some common speakers mainly including moving-coil speakers, magnetic speakers, capacitive speakers, piezoelectric speakers, etc.. The moving-coil speakers have the characteristics of relatively simple manufacture, low cost, low-frequency sounding advantage, etc.

The conventional moving-coil speaker, also known as a moving-coil speaker module, usually comprises a speaker module housing and a speaker unit. The speaker module housing typically comprises an upper housing and a lower housing which are assembled together to form a cavity to accommodate the speaker unit. The speaker unit typically comprises a vibration system, a magnetic circuit system and an auxiliary system. The above-mentioned auxiliary system comprises a housing which may accommodate the vibration system and the magnetic circuit system. The above-mentioned vibration system comprises a vibration diaphragm and a vibrating voice coil secured to one side of the vibration diaphragm. The vibration diaphragm comprises a vibration diaphragm body and a DOME (spherical top) secured to the center of the vibration diaphragm body. The vibration diaphragm body comprises a fixed portion secured to the housing, a concave or convex edge portion integrated with the fixed portion and a planar portion located in the edge portion. The magnetic circuit system comprises a frame, a magnet and a washer secured to the frame. The auxiliary system comprises the housing.

With higher and higher demands on the acoustic performance of the moving-coil speaker from people, a technology employing capacitance to feed back vibration displacement of the vibration diaphragm of the speaker unit is applied extensively. Particularly, in this technology, there is a need to dispose a steel sheet on the upper housing of the speaker module housing to serve as an upper electrode plate of a capacitor, and to dispose another steel sheet on the DOME of the vibration diaphragm to serve as a lower electrode plate of the capacitor. The terms "upper" and "lower" are only used to distinguish the relative position between the two electrode plates but not to represent their final position relation in the speaker unit. When the moving-coil speaker works, the capacitance of the capacitor changes to feed back vibration displacement of the vibration diaphragm, thus improving the acoustic performance of the speaker by monitoring the vibration displacement of the vibration diaphragm of the speaker unit.

Since the lower electrode plate of the capacitor disposed on the DOME needs to be led out by a lead to acquire capacitance data of the electrode plates, and vibrates when the DOME and the vibration diaphragm vibrate together, the lead on the lower electrode plate of the capacitor is easy to fracture due to vibration. Consequently, the capacitance data may not be acquired. The vibration displacement of the vibration diaphragm may not be monitored. The reliability of capacitance data acquisition is low.

SUMMARY OF THE INVENTION

An objective of the present invention is to provide a vibration diaphragm which may guarantee the reliability of capacitance data acquisition on the premise of meeting the requirement for capacitance data acquisition.

According to an aspect of the present invention, there is provided a vibration diaphragm, comprising an annular support member, a first vibration diaphragm layer and a circuit layer. The annular support member comprises a support body and an inner hole. The first vibration diaphragm layer is fixedly connected to the support body. The circuit layer is located on a surface of the first vibration diaphragm layer that is adjacent to a vibrating voice coil and is fixedly connected to the first vibration diaphragm layer and the support body. The circuit layer is provided with a circuit area, a capacitance area and a capacitance solder pad. The capacitance area is a capacitance electrode plate formed on the first vibration diaphragm layer and is communicated with the capacitance solder pad by means of the circuit area. The capacitance solder pad corresponds to the support body.

Preferably, an end surface of the support body that is away from the vibrating voice coil is provided with a support body downward concave portion. The first vibration diaphragm layer is fixedly connected to the support body downward concave portion and an inner wall of the inner hole.

More preferably, a groove configured to enhance a binding force between the first vibration diaphragm layer and the support body is formed in the support body downward concave portion.

Preferably, the circuit layer comprises a circuit layer connecting portion and a circuit layer body portion. The circuit layer connecting portion is fixedly connected to an end surface of the support body that is adjacent to the vibrating voice coil. The capacitance solder pad is located on the circuit layer connecting portion. The circuit layer body portion is fixedly connected to the first vibration diaphragm layer.

More preferably, the circuit layer is further provided with an inner voice coil solder pad which can be fixedly connected to a voice coil lead of the vibrating voice coil and an outer voice coil solder pad which can be fixedly connected to a current input wire of a speaker unit. The inner voice coil solder pad is connected to the outer voice coil solder pad by means of the circuit area. The inner voice coil solder pad, the circuit area and the capacitance area are all located on the circuit layer body portion. The outer voice coil solder pad is located on the circuit layer connecting portion.

Furthermore, an edge of the circuit layer is rectangular. An inward concave portion which is recessed inwards is formed in each of four corners of the edge of the circuit layer. The outer voice coil solder pads comprise two outer voice coil solder pads and the capacitance solder pads comprise two capacitance solder pads. The two outer voice coil solder pads are located respectively on the two inward concave portions at the relatively shorter edges of the circuit layer. The two capacitance solder pads are located respectively on the other two inward concave portions of the circuit layer.

Preferably, the vibration diaphragm further comprises a second vibration diaphragm layer which is located on a surface of the circuit layer that is away from the first vibration diaphragm layer and is fixedly connected to the circuit layer.

More preferably, the shape of the second vibration diaphragm layer is matched with that of the circuit layer.

Another objective of the present invention is to provide a manufacturing method for a vibration diaphragm to realize better combination among the annular support member, the first vibration diaphragm layer and the circuit layer.

According to a second aspect of the present invention, there is provided a manufacturing method for a vibration diaphragm, comprising the following steps: (1) forming a circuit area, a capacitance area, a capacitance solder pad, an inner voice coil solder pad and an outer voice coil solder pad on a circuit layer; (2) gluing the circuit layer in the step (1) onto an annular support member; and (3) forming a first vibration diaphragm layer on the circuit layer and the annular support member in the step (2) by an injection molding process, wherein the first vibration diaphragm layer is located on a surface of the circuit layer that is away from a vibrating voice coil.

Preferably, the manufacturing method for the vibration diaphragm further comprises the following step after the step (3): (4) forming a second vibration diaphragm layer on a surface of the circuit layer in the step (3) that is adjacent to the vibrating voice coil by an injection molding process.

The inventor of the present invention discovered the problem that capacitance data acquisition fails due to vibrating breakage of a lead on an electrode plate does exist in the prior art. Therefore, a technical task to be implemented by the present invention or a technical problem to be solved by the present invention has never been thought or expected by those skilled in the art. Thus, the present invention is a novel technical solution.

A technical benefit of the present invention lies in that the capacitance area is provided on the circuit layer. That is, a lower electrode plate of a capacitor is directly disposed on the circuit layer. Meanwhile, the annular support member supports the first vibration diaphragm layer and the circuit layer. The capacitance solder pad corresponds to the support body. Hence, the lead connected to the capacitance solder pad and configured to acquire capacitance data may not vibrate with the vibration diaphragm, and accordingly, will not be broken by vibration, thus ensuring the reliability of capacitance data acquisition.

Another technical benefit of the present invention lies in that in the manufacturing method for the vibration diaphragm, the circuit layer is fixedly connected to the annular support member at first. Then, the first vibration diaphragm layer is formed by injection molding. The strength of connection between the first vibration diaphragm layer and the annular support member, as well as that between the first vibration diaphragm layer and the circuit layer, is high. The first vibration diaphragm layer may protect the circuit layer. Further, the reliability of capacitance data acquisition is greatly improved.

Further features of the present invention, as well as advantages thereof, will become apparent from the following detailed description of exemplary embodiments of the present invention with reference to the attached drawings.

BRIEF DESCRIPTION OF THE DRAWINGS

The accompanying drawings, which are incorporated in and constitute a part of the specification, illustrate embodiments of the present invention and, together with the description, serve to explain the principles of the present invention.

Figure 1:
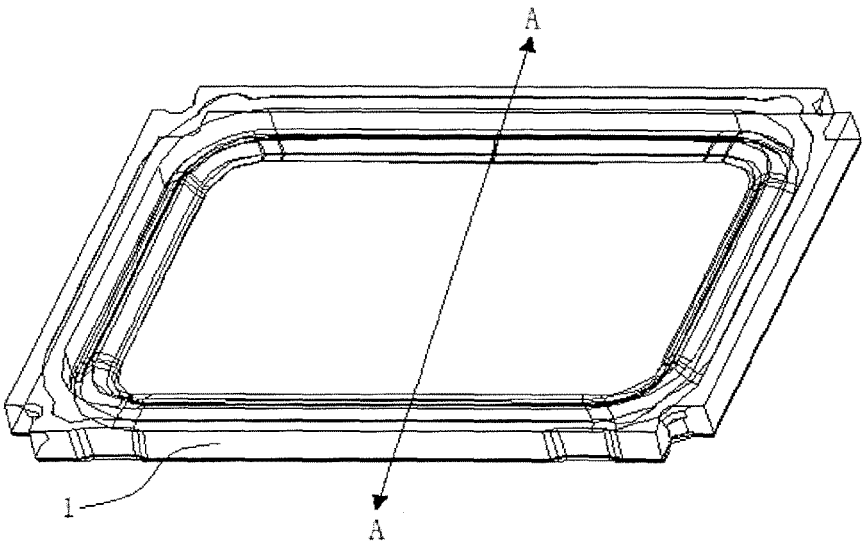
FIG. 1 is a structural schematic view of a perspective of a vibration diaphragm in one embodiment of the present invention.
Figure 2:
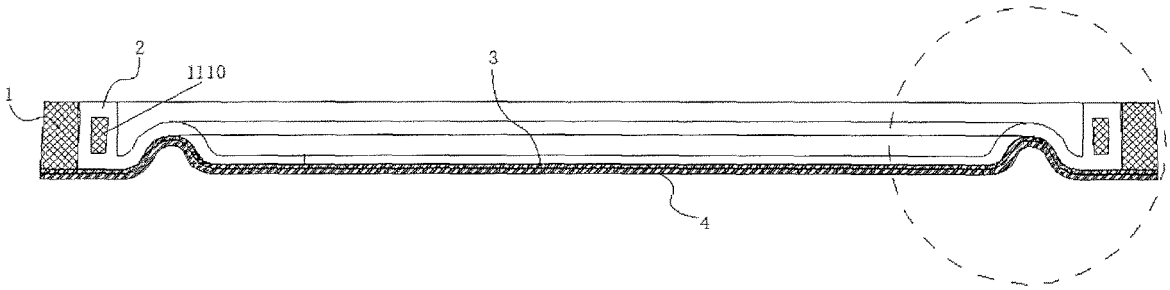
FIG. 2 is an A-A section view in FIG. 1.

Reference numbers in the drawings are described as below:annular support member-1; support body-11; support body downward concave portion-111; groove-1110; inner hole-12; first vibration diaphragm layer-2; circuit layer-3; circuit layer connecting portion-31; capacitance solder pad-311; outer voice coil solder pad-312; inward concave portion-313; circuit layer body portion-32; inner voice coil solder pad-321; second vibration diaphragm layer-4.

DETAILED DESCRIPTION OF THE EMBODIMENTS

Various exemplary embodiments of the present invention will now be described in detail with reference to the accompanying drawings. It should be noted that the relative arrangement of the components and steps, numerical expressions and numerical values set forth in these embodiments do not limit the scope of the present invention unless it is specifically stated otherwise.

The following description of at least one exemplary embodiment is merely illustrative in nature and by no means is to be construed as any limitation on the present invention and its application or use.

Techniques, methods, and apparatuses known to one of ordinary skill in the relevant art may not be discussed in detail but, where appropriate, the techniques, methods, and apparatuses should be considered part of the description.

In all of the examples shown and discussed herein, any specific value should be interpreted as merely illustrative and not as a limitation. Therefore, other examples of the exemplary embodiments may have different values.

It should be noted that like reference numbers and letters represent similar terms in the following figures, and therefore, an item needs not to be further discussed in subsequent figures as soon as it is defined in a previous drawing.

In order to solve the problem of low reliability of capacitance data acquisition, the present invention provides a vibration diaphragm, as shown in FIGS. 1 to 5, comprising an annular support member 1, a first vibration diaphragm layer 2 and a circuit layer 3. The structure of the above-mentioned first vibration diaphragm layer 2 corresponds to that of a vibration diaphragm body in the prior art. A vibrating function of the vibration diaphragm may be achieved. That is, the first vibration diaphragm layer 2 typicallyat least comprises an edge portion and a planar portion and may be made of a material of a common vibration diaphragm body or a silica gel material. Particularly, a silica gel vibration diaphragm is an elastomer formed by high-temperature curing of silica gel and has the advantages of high elasticity and mechanical strength, excellent thermal stability, stable chemical property, wide application temperature range, favorable weatherability, etc. The annular support member 1 comprises a support body 11 and an inner hole 12. The first vibration diaphragm layer 2 is fixedly connected to the support body 1 by means by gluing, welding, injection molding, or the like. It is easily conceivable to those skilled in the art that the annular support member 1 may be a component secured to a housing of a speaker unit or the annular support member 1 may be a part of the housing of the speaker unit. That is, the annular support member 1 may be integrated with the housing of the speaker unit. The circuit layer 3 is located on a surface of the first vibration diaphragm layer 2 that is adjacent to a vibrating voice coil, and is fixedly connected to the first vibration diaphragm layer 2 and the support body 11 by means of gluing, welding, or the like. A circuit area (not shown), a capacitance area (not shown) and a capacitance solder pad 311 are provided on the circuit layer 3. The capacitance area is connected to the capacitance solder pad 311 by means of the circuit area. The capacitance solder pad 311 corresponds to the support body 11. The capacitance area is a lower electrode plate of a capacitor formed on the first vibration diaphragm layer 2. The circuit area is a circuit pattern connected between the capacitance area and the capacitance solder pad 311. The circuit layer 3 may be an FPC (Flexible Printed Circuit) or made of a silica gel material. The circuit area and the capacitance area on the circuit layer may be formed by an etching method when the circuit layer 3 is the FPC and by an LDS (Laser Direct Structuring) method when the circuit layer 3 is made of the silica gel material. Capacitance data are acquired by a lead, which is welded with the capacitance solder pad 311 and configured to acquire the capacitance data. Correspondence between the capacitance solder pad 311 and the support body 11 means that the position of the capacitance solder pad 311 on the circuit layer 3 should correspond to that of the support body 11 to guarantee that the support body 11 may support the capacitance solder pad 311. Thus, the capacitance solder pad 311 supported by the support body 11 may not vibrate with the first vibration diaphragm layer 2. Of course, the acquisition lead connected to the capacitance solder pad 311 and configured to acquire the capacitance data may not vibrate with the first vibration diaphragm layer 2 either.

The capacitance area of the vibration diaphragm is provided on the circuit layer 3. That is, the lower electrode plate of the capacitor is directly provided on the circuit layer 3. Meanwhile, the annular support member 1 supports the first vibration diaphragm layer 2 and the circuit layer 3. The capacitance solder pad 311 corresponds to the support body 11. Thus, the lead connected to the capacitance solder pad 311 and configured to acquire the capacitance data may not vibrate with the vibration diaphragm, and accordingly, will not be broken by vibration, thus ensuring the reliability of capacitance data acquisition.

Figure 5:
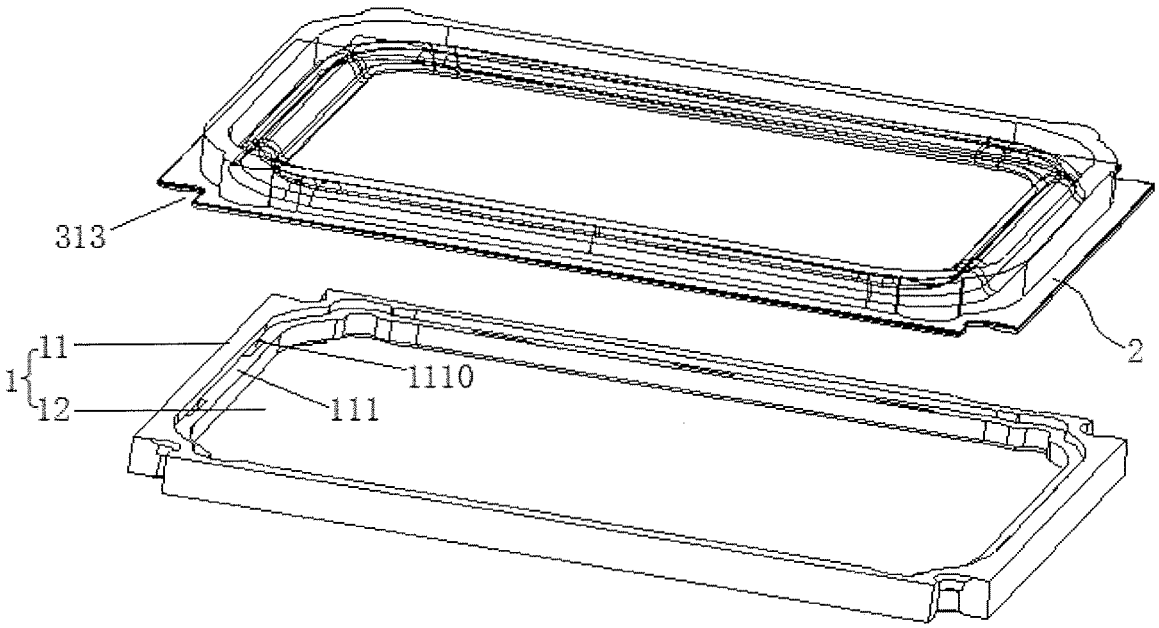
FIG. 5 is an exploded view of a vibration diaphragm in one embodiment of the present invention.

A support body downward concave portion 111 is disposed on an end surface of the support body 11 that is away from the vibrating voice coil, so as to enhance the tightness and the reliability of connection between the support body 11 and the first vibration diaphragm layer 2. The first vibration diaphragm layer 2 is fixedly connected to the support body downward concave portion 111 and an inner wall of the inner hole 12. The support body downward concave portion 111 may adopt an annular structure matched with the shape of the annular support member 1. Besides, the support body downward concave portion 111 is preferably located at an inner ring portion of the support body 11, as shown in FIG. 5.

Furthermore, a groove 1110 configured to enhance a binding force between the first vibration diaphragm layer 2 and the support body 11 is formed in the support body downward concave portion 111. Of course, it is easily conceivable to those skilled in the art that a protrusion matched with the groove 1110 should be formed on the first vibration diaphragm layer 2. Particularly, the grooves 1110 may be uniformly distributed along the support body downward concave portion 111.

Figure 3:
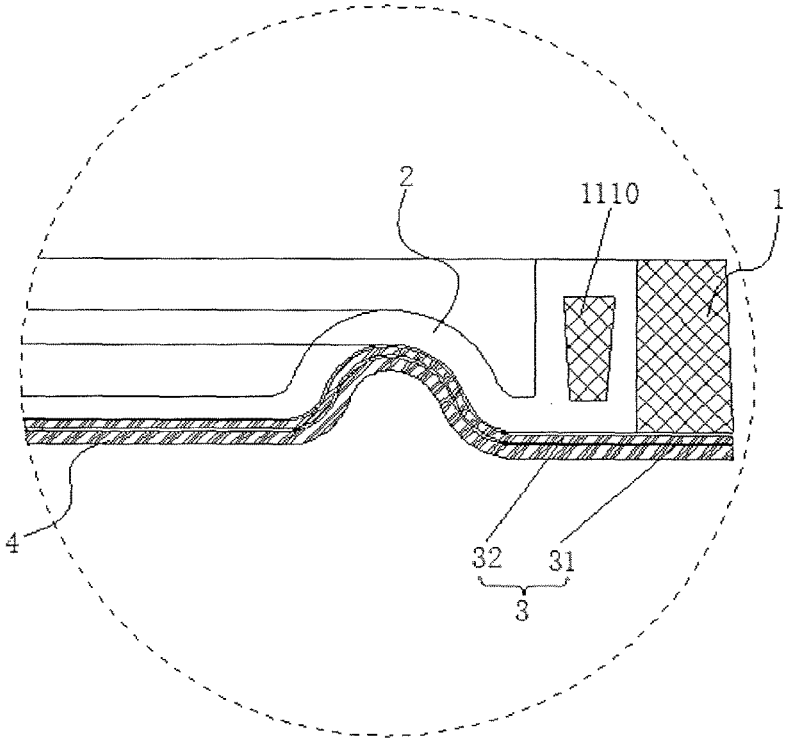
FIG. 3 is a partial enlarged view of FIG. 2.

Since the circuit layer 3 is fixedly connected to not only the annular support member 1 but also the first vibration diaphragm layer 2, as shown in FIG. 3, the circuit layer 3 comprises a circuit layer connecting portion 31 and a circuit layer body portion 32 in order to guarantee the reliability in securing the circuit layer 3 and the performance of all functional areas on the circuit layer 3 on the premise of disposing the circuit layer 3 more conveniently. The circuit layer connecting portion 31 is fixedly connected to an end surface of the support body 11 that is adjacent to the vibrating voice coil. The capacitance solder pad 311 is located on the circuit layer connecting portion 31. The circuit layer body portion 32 is fixedly connected to the first vibration diaphragm layer 2. The fixed connection between the circuit layer connecting portion 31 and the support body 11 may be realized by means of gluing or the like. The fixed connection between the circuit layer body portion 32 and the first vibration diaphragm layer 2 may be realized by means of gluing or by injection molding thefirst vibration diaphragm layer 2 on the circuit layer body portion 32. As the capacitance solder pad 311 is disposed on the circuit layer connecting portion 31, the support body 11 may support the capacitance solder pad 311. Thus, the capacitance solder pad 311 supported by the support body 11 may not vibrate with the first vibration diaphragm layer 2. Of course, the lead connected to the capacitance solder pad 311 and configured to acquire capacitance data may not vibrate with the first vibration diaphragm layer 2 either. It is easily conceivable to those skilled in the art that all the functional areas, for example, the capacitance area or the capacitance solder pad 311, may be disposed on the circuit layer connecting portion 31 or the circuit layer body portion 32 of the circuit layer 3 according to actual demands.

Figure 4:
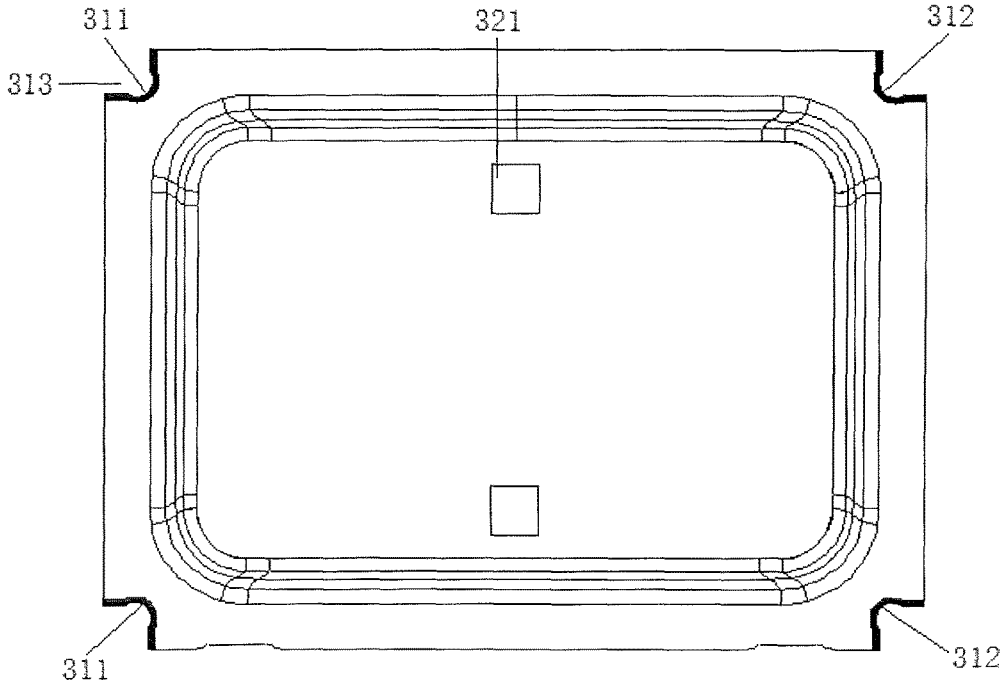
FIG. 4 is a structural schematic view of another perspective of a vibration diaphragm in one embodiment of the present invention.

As for a speaker unit, the vibrating voice coil is usually secured to a surface of the vibration diaphragm that is adjacent to a magnet. Therefore, according to a preferred embodiment as illustrated in FIG. 4, the circuit layer 3 further includes an inner voice coil solder pad 321 which may be fixedly connected to a voice coil lead of the vibrating voice coil, and an outer voice coil solder pad 312 which may be fixedly connected to a current input wire of the speaker unit. The inner voice coil solder pad 321 is connected to the outer voice coil solder pad 312 by means of the circuit area. The above-mentioned fixed connections may be realized in a welding manner. Current is input into the vibrating voice coil from the outer voice coil solder pad 312, the circuit area and the inner voice coil solder pad 321 to electrify the vibrating voice coil.

The inner voice coil solder pad 321, the circuit area and the capacitance area are all disposed on the circuit layer body portion 32. The outer voice coil solder pad 312 is located on the circuit layer connecting portion 31, such that the voice coil lead of the vibrating voice coil is fixedly connected to the inner voice coil solder pad 321 located on the circuit layer body portion 32. Not only is the wiring distance of the voice coil lead shortened to ensure that the voice coil lead rarely interferes with peripheral components, but also the number of the voice coil leads may be increased to prevent the vibrating voice coil from stopping working due to a brokenvoice coilcaused by vibration of the vibration diaphragm. The outer voice coil solder pad 312 is located on the circuit layer connecting portion 31 such that the support body 11 may support the outer voice coil solder pad 312. In this way, the outer voice coil solder pad 312 supported by the support body 11 may not vibrate with the first vibrating vibration diaphragm layer 2. Of course, the current input wire of the speaker unit connected with the voice coil solder pad 312 will not be broken either as a result of vibrating with the first vibration diaphragm layer 2.

Furthermore, an edge of the circuit layer 3 is rectangular. An inward concave portion 313 which is recessed inwards is formed in each of four corners of the edge of the circuit layer 3. The numbers of the outer voice coil solder pads 312 and the capacitance solder pads 311 are two respectively. The two outer voice coil solder pads 312 are respectively located on the two inward concave portions 313 at the relatively shorter edges of the circuit layer 3. The two capacitance solder pads 311 are respectively located on the other two inward concave portions 313 of the circuit layer 3. The term "inward" means a direction facing the center of the circuit layer 3. The disposing modes of the capacitance solder pads 311 and the outer voice coil solder pads 312 not only facilitate convenient disposing of the lead or wire fixedly connected to the solder pads but also better prevent the capacitance solder pads 311 and the outer voice coil solder pads 312 from being affected by vibration of the vibration diaphragm.

In another preferred embodiment of the present invention, the vibration diaphragm further comprises a second vibration diaphragm layer 4 which is located on a surface of the circuit layer 3 that is away from the first vibration diaphragm layer 2, and is fixedly connected to the circuit layer 3 through injection molding on the circuit layer 3. That is, the second vibration diaphragm layer 4 is formed on the circuit layer 3 by injection molding. Of course, it is easily conceivable to those skilled in the art that the second vibration diaphragm layer 4 should not cover the capacitance solder pad 311, the outer voice coil solder pad 312 or the inner voice coil solder pad 321 on the circuit layer 3. The structure of the second vibration diaphragm layer 4 corresponds to that of a vibration diaphragm body in the prior art. A vibrating function of the vibration diaphragm may be realized. That is, the second vibration diaphragm layer 4 typicallyat least comprises an edge portion and a planar portion and may be made of a material of a common vibration diaphragm body or a silica gel material. The second vibration diaphragm layer 4 not only facilitates good vibration performance of the vibration diaphragm and improves the acoustic performance of the speaker unit but also may protect the circuit layer 3. The vibrating voice coil may be secured to the second vibration diaphragm layer 4 by means of gluing, or the like when the vibration diaphragm in the embodiment serves as a component of the speaker unit.

In order to better protect the circuit layer 3, the shape of the second vibration diaphragm layer 4 is matched with that of the circuit layer 3.

Figure 6:
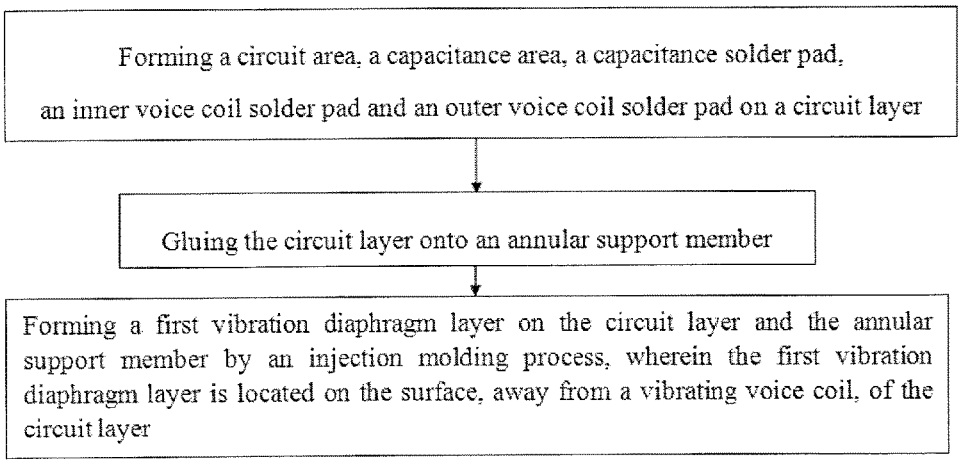
FIG. 6 is a flow chart of a manufacturing method of a vibration diaphragm provided by the present invention.

For better combination among an annular support 1, a first vibration diaphragm layer 2 and a circuit layer 3, the present invention provides a manufacturing method for a vibration diaphragm. As shown in FIG. 6, The method comprises the following steps.

(1) A circuit area, a capacitance area, a capacitance solder pad 311, an inner voice coil solder pad 321 and an outer voice coil solder pad 312 are formed on a circuit layer 3. The capacitance area forms a lower electrode plate of a capacitor. The circuit area comprises a circuit pattern connected between the capacitance area and the capacitance solder pad 311. The above-mentioned mode of forming the functional areas and the solder pads on the circuit layer may be determined by the material of the circuit layer 3. For example, the circuit layer 3 may be an FPC (Flexible Printed Circuit) or made of a silica gel material. The circuit area and the capacitance area on the circuit layer 3 may be formed by an etching method when the circuit layer 3 is the FPC and by an LDS (Laser Direct Structuring) method when the circuit layer 3 is made of the silica gel material. Capacitance data are acquired by a lead, which is welded with the capacitance solder pad 311 and configured to acquire the capacitance data.

(2) The circuit layer 3 in the step (1) is glued onto an annular support member 1. It is easily conceivable to those skilled in the art that the annular support member 1 may be a component that is secured to a housing of a speaker unit by means of bolted connection or be a part of the housing of the speaker unit. That is, the annular support member 1 may be integrated with the housing of the speaker unit. The circuit layer 3 is conveniently secured to the annular support member in a gluing manner, thus facilitating simplification of the process.

(3) A first vibration diaphragm layer 2 is formed on the circuit layer 3 and the annular support member 1 in the step (2) by an injection molding process. The first vibration diaphragm layer 2 is located on a surface of the circuit layer 3 that is away from a vibrating voice coil. The structure of the first vibration diaphragm layer 2 corresponds to that of a vibration diaphragm body in the prior art. A vibrating function of the vibration diaphragm may be achieved. That is, the first vibration diaphragm layer 2 typicallyat least comprises an edge portion and a planar portion and may be made of a material of a common vibration diaphragm body or a silica gel material. Particularly, a silica gel vibration diaphragm is an elastomer formed by high-temperature curing of silica gel and has the advantages of high elasticity and mechanical strength, excellent thermal stability, stable chemical property, wide application temperature range, favorable weatherability, etc.

In the manufacturing method for the vibration diaphragm, the circuit layer 3 is fixedly connected to the annular support member 1 first. Then, the first vibration diaphragm layer 2 is formed by injection molding. The strength of connection between the first vibration diaphragm layer 2 and the annular support member 1, as well as between the first vibration diaphragm layer 2 and the circuit layer 3, is high. The first vibration diaphragm layer 2 may protect the circuit layer 3. Further, the reliability of capacitance data acquisition is greatly improved.

Furthermore, the manufacturing method also comprises the following step after the step (3).

(4) A second vibration diaphragm layer 4 is formed on a surface of the circuit layer 3 in the step (3) that is adjacent to the vibrating voice coil by the injection molding process. The structure of the second vibration diaphragm layer 4 corresponds to that of a vibration diaphragm body in the prior art. A vibrating function of the vibration diaphragm may be achieved. The second vibration diaphragm layer 4 typically at least comprises an edge portion and a planar portion and may be made of a material of a common vibration diaphragm body or a silica gel material. The second vibration diaphragm layer 4 not only facilitates good vibration performance of the vibration diaphragm and improves the acoustic performance of the speaker unit, but also may protect the circuit layer 3.

Although some specific embodiments of the present invention have been described in detail by way of example, those skilled in the art should understand that the above examples are only for the purpose of illustration and are not intended to limit the scope of the present invention. It will be understood by those skilled in the art that the above embodiments may be modified without departing from the scope and spirit of the present invention. The scope of the present invention is defined by the appended claims.

What is claimed is:

1. A vibration diaphragm, characterized in comprising an annular support member, a first vibration diaphragm layer and a circuit layer, the annular support member comprising a support body and an inner hole, the first vibration diaphragm layer being fixedly connected to the support body, and the circuit layer being located on a surface of the first vibration diaphragm layer that is adjacent to a vibrating voice coil, being fixedly connected to the first vibration diaphragm layer and the support body, and being provided with a circuit area, a capacitance area and a capacitance solder pad, wherein the capacitance area is a capacitance electrode plate formed on the first vibration diaphragm layer and is communicated with the capacitance solder pad by means of the circuit area, and the capacitance solder pad corresponds to the support body.

2. The vibration diaphragm according to claim 1, characterized in that an end surface of the support body that is away from the vibrating voice coil is provided with a support body downward concave portion, and the first vibration diaphragm layer is fixedly connected to the support body downward concave portion and an inner wall of the inner hole.

3. The vibration diaphragm according to claim 2, characterized in that a groove configured to enhance a binding force between the first vibration diaphragm layer and the support body is formed in the support body downward concave portion.

4. The vibration diaphragm according to claim 1, characterized in that the circuit layer comprises a circuit layer connecting portion and a circuit layer body portion, the circuit layer connecting portion being fixedly connected to an end surface of the support body that is adjacent to the vibrating voice coil and the capacitance solder pad being located on the circuit layer connecting portion, and the circuit layer body portion being fixedly connected to the first vibration diaphragm layer.

5. The vibration diaphragm according to claim 4, characterized in that the circuit layer is further provided with an inner voice coil solder pad which can be fixedly connected to a voice coil lead of the vibrating voice coil and an outer voice coil solder pad which can be fixedly connected to a current input wire of a speaker unit, the inner voice coil solder pad being connected to the outer voice coil solder pad by means of the circuit area, the inner voice coil solder pad, the circuit area and the capacitance area being all located on the circuit layer body portion, and the outer voice coil solder pad being located on the circuit layer connecting portion.

6. The vibration diaphragm according to claim 5, characterized in that an edge of the circuit layer is rectangular, an inward concave portion which is recessed inwards being formed in each of four corners of the edge of the circuit layer, the outer voice coil solder pads comprise two outer voice coil solder pads and the capacitance solder pads comprise two capacitance solder pads, the two outer voice coil solder pads being located respectively on the two inward concave portions at the shorter edges of the circuit layer; and the two capacitance solder pads being located respectively on the other two inward concave portions of the circuit layer.

7. The vibration diaphragm according to claim 1, characterized in further comprising a second vibration diaphragm layer, the second vibration diaphragm layer being located on a surface of the circuit layer that is away from the first vibration diaphragm layer and being fixedly connected to the circuit layer.

8. The vibration diaphragm according to claim 7, characterized in that the shape of the second vibration diaphragm layer is matched with that of the circuit layer.

* * * * *